US008534441B2

(12) United States Patent
Jiang et al.

(10) Patent No.: US 8,534,441 B2
(45) Date of Patent: Sep. 17, 2013

(54) PAPER MONEY TRANSMISSION AND STORAGE DEVICE

(75) Inventors: Zhuang Jiang, Guangzhou (CN); Dong Tan, Guangzhou (CN); Zhiyong Liu, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 13/500,283

(22) PCT Filed: Sep. 20, 2010

(86) PCT No.: PCT/CN2010/077135

§ 371 (c)(1),
(2), (4) Date: Apr. 4, 2012

(87) PCT Pub. No.: WO2011/044814

PCT Pub. Date: Apr. 21, 2011

(65) Prior Publication Data

US 2012/0199053 A1 Aug. 9, 2012

(30) Foreign Application Priority Data

Oct. 13, 2009 (CN) ..... 2009 1 0193047

(51) Int. Cl.
*G07F 7/04* (2006.01)

(52) U.S. Cl.
USPC ..... 194/206; 194/344; 194/350

(58) Field of Classification Search
USPC ..... 194/206, 350, 344; 312/183, 188, 312/293.2; 271/145, 147; 109/23
See application file for complete search history.

(56) References Cited

U.S. PATENT DOCUMENTS 7,249,707 B2 7/2007 Yokoi et al.
7,322,518 B2 1/2008 Yokoi et al.
(Continued)

FOREIGN PATENT DOCUMENTS

| | | | |
|---|---|---|---|
| CN | 2698472 | Y | 5/2005 |
| DE | 40 05 291 | A1 * | 8/1990 |
| JP | 2005346685 | A | 12/2005 |

OTHER PUBLICATIONS

International Search Report dated Dec. 30, 2010 from corresponding International Application No. PCT/CN2010/077135.

*Primary Examiner* — Mark Beauchaine
(74) *Attorney, Agent, or Firm* — Wolf, Greenfield & Sacks, P.C.

(57) ABSTRACT

A paper money transmission and storage device with locking mechanism in financial equipment comprises a paper money transmission channel (1) and a cashbox set (2) for storing paper money, wherein the cashbox set (2) is mounted in a cashbox set bracket (21) which is a box of which one side is covered by the overturned paper money transmission channel (1). An end of the paper money transmission channel (1) is pivoted to a side wall (212) of the cashbox set bracket (21). A locking mechanism (3) arranged on an end of the paper money transmission channel (1) opposite to the pivoted end, comprises: a fixed bracket (31) which is fixed on the end of the paper money transmission channel (1) for mounting and supporting parts required for locking; a long-distance locking part which comprises a rotation shaft (32) across the two opposite end faces of the fixed bracket (31), and a locking hook (33) fixed to the two ends of the rotation shaft (32), wherein the locking hook (33) is connected with a locking pole (2121) arranged on the side wall (212) of the cashbox set bracket (21) in the opening and closing mode; and an unlocking handle (34) which is fixed on the rotation shaft (32), capable of driving the rotation shaft (32) to rotate freely so as to drive the locking hook (33) and the corresponding locking pole (2121) to achieve opening-closing operation.

10 Claims, 5 Drawing Sheets

(56) References Cited

U.S. PATENT DOCUMENTS

2005/0263582 A1 12/2005 Yokoi et al.
2007/0228151 A1 10/2007 Yokoi et al.
2007/0267808 A1 11/2007 Cha et al.

* cited by examiner

PAPER MONEY TRANSMISSION AND STORAGE DEVICE

The present application is a U.S. National Stage Patent Application of PCT Application Number PCT/CN2010/077135, filed on Sep. 20, 2010, which application claims the benefit of priority to Chinese patent application No. 200910193047, filed with the Chinese State Intellectual Property Office on Oct. 13, 2009. The entire disclosures thereof are incorporated herein by reference.

FIELD OF THE INVENTION

The present invention relates to a paper money transporting and storing device, and more particular to a paper money transporting passage and a storing device having a locking mechanism used in a financial instrument.

BACKGROUND OF THE INVENTION

Existing financial self-service terminal includes the cash deposit machine, the automatic teller machine and the automatic depositing and withdrawing system. In these machines which may directly deal with paper currency, in order to achieve the exchange of paper money between the user and the machine, it is necessary to install a paper money transporting passage device in these machines. The device is used to transport paper money to be deposited into the self-service instrument by user to the terminal cashbox and/or transport paper money in the terminal cashbox to the user.

Particularly, the paper money transporting passage device in the automatic depositing and withdrawing system is used to transport the notes dispensed by an upper machine mechanism and store the notes into the cashbox, or transport the paper money storing in the cashbox to the upper machine mechanism to be dispensed. The upper machine mechanism includes a paper money identifying device, a paper money temporarily storing device and a paper money collecting device. The paper money collecting device allows the user to take out paper money or put in paper money. A lower machine mechanism includes a cashbox assembly for storing paper money. A paper money transporting passage is provided between the upper machine mechanism and the cashbox assembly of the lower machine mechanism. Generally, the paper money transporting passage covers and is pressed on the cashbox so as to achieve a precise positioning and aligning between the transporting passage and a paper money inlet/outlet of the cashbox, thereby ensuring the smooth transportation of paper money.

The conventional method for fixing the paper money transporting passage device to the cashbox assembly of the lower machine mechanism is generally that the transporting passage device is pressed by the upper machine mechanism and then closed with the side walls of the cashbox assembly bracket for the lower machine mechanism, so as to position and fix the transporting passage. In this method, the positioning between the transporting passage and the cashbox is achieved by the cooperation between bearings installed on the passage and a floating elastic sheet installed on an associated safe cabinet. When the lower machine mechanism is pushed into, the transporting passage is pressed by the floating elastic sheet and tightly fitted with the side walls of the cashbox assembly bracket for the lower machine mechanism.

In view of the above fixing method, the fastening of the transporting passage is achieved by a clamp force formed from the downward pressure of the floating elastic sheet on the safe cabinet towards the components below the transporting passage. However, the cashbox below the transporting passage is not applicable to support the transporting passage. Thus, the transporting passage is needed to be supported by side walls of an additional cashbox bracket. Therefore, it is required to lift the cashbox by a large height when replacing the cashbox, which increases the labor intensity of the operator and is inconvenient for use.

In addition, the transporting passage is fastened by cooperation between bearings installed on the passage and the floating elastic sheet installed on associated safe cabinet. When the lower machine mechanism is pushed into, the passage is pressed in position, which certainly influences the independency of the lower machine mechanism. Besides, the structure of the opening-closing mechanism of this transporting passage is relatively complex, and is inconvenient for use.

SUMMARY OF THE INVENTION

In view of the problems of non-independency, inconvenient operation of the transporting passage and the problem of insufficient reliability in positioning between the transporting passage and the cashbox, the present invention provides a paper money transporting and storing device having a long locking mechanism.

The object of the present invention is achieved by the following solutions.

The paper money transporting and storing device includes a paper money transporting passage and a cashbox assembly for storing paper money. The cashbox assembly is disposed within a cashbox assembly bracket. The cashbox assembly bracket is a box body, one surface of which may be covered by turning the paper money transporting passage. One end of the paper money transporting passage is pivoted to a side wall of the cashbox assembly bracket. A locking mechanism is provided at the other end of the paper money transporting passage opposite to the pivoted end. The locking mechanism includes: a fixed bracket, which is fixed to the other end of the paper money transporting passage in order to install and support components necessary for locking; a long locking member, which includes a rotation shaft extending across opposite end surfaces of the fixed bracket and locking hooks fixed to both ends of the rotation shaft, wherein an openable connection is formed between the locking hooks and locking pins correspondingly provided on side walls of the cashbox assembly bracket; and an unlocking handle, which is fixed to the rotation shaft in order to drive the rotation shaft to freely rotate so that the locking hooks are driven to be engaged with or disengaged from corresponding locking pins.

Preferably, a return torsion spring is provided on the rotation shaft. One end of the return torsion spring is fixed to the fixed bracket, and the other end of the return torsion spring is fixed relative to the rotation shaft, so as to provide return force after the locking hooks are disengaged from an engagement position.

Preferably, a positioning assistant member having a positioning hole is provided on the side wall of the paper money transporting passage, and a positioning pin corresponding to the positioning hole is provided on corresponding side wall of the cashbox assembly bracket.

Preferably, a gas spring is provided between the paper money transporting passage and the cashbox assembly bracket. One end of the gas spring is pivoted to the side wall of the paper money transporting passage, and the other end of the gas spring is pivoted to corresponding side wall of the cashbox assembly bracket.

Preferably, a turning stop mechanism is provided between the paper money transporting passage and the cashbox assembly bracket. The turning stop mechanism includes a stop sheet. One end of the stop sheet is pivoted to the side wall of the cashbox assembly bracket. A stop pin is provided on a surface of the other end of the stop sheet facing the paper money transporting passage. A sliding groove is provided on the side wall of the paper money transporting passage corresponding to the stop pin and is parallel to the plane of the transporting passage. An upward angled location groove is formed at the end of the sliding groove near the pivot shaft of the transporting passage and used to reliably stop the transporting passage when the transporting passage is opened in position.

Preferably, a transporting passage closed in-position detecting mechanism is provided on the side wall of the cashbox assembly bracket.

Further, the detecting mechanism includes a U-shape sensor, a rotation member and a return torsion spring for returning the rotation member. The rotation member has a check plate capable of entering into the U-shape sensor.

Further, the rotation member is pivoted to the side wall of the cashbox assembly bracket through a pivot shaft. The return torsion spring is surroundingly connected to the pivot shaft. One end of the return torsion spring is fixed to the rotation member, and the other end of the return torsion spring is fixed to the pivot shaft or a fixing mechanism of the pivot shaft.

Further, a paper money transporting passage pressing handle is provided at one end of the rotation member opposite to the sensor check plate. The pressing handle and the sensor check plate form a V-shape rotation member. When the paper money transporting passage is closed in position, the transporting passage presses the pressing handle so as to rotate the V-shape rotation member around the pivot shaft, such that the sensor check plate departs from the U-shape sensor. After the paper money transporting passage is opened, the V-shape rotation member is rotated in a reverse direction by the return torsion spring, such that the sensor check plate enters into the U-shape sensor.

Preferably, the cashbox assembly bracket is configured to be open at an upper portion of the side wall thereof corresponding to the locking mechanism.

Therefore, compared with the prior art, the paper money transporting and storing device according to the present invention has the following advantages:

First, the cashbox may be easily drawn out when replacing owning to the open design of the side wall of the cashbox assembly bracket, which reduces the labor intensity and is conveniently used.

Second, the paper money transporting passage may be entirely positioned by the cashbox assembly bracket, such that the paper money transporting passage and the storing device become independent modules, which reduces the requirements of the cooperation between them and the other modules and is conveniently installed.

Third, it is more convenient and safe to open or close the paper money transporting passage by using the assistant gas spring and the turning stop mechanism.

Fourth, the transporting passage closed in-position detecting mechanism may ensure that the passage is closed in position, so as to engage smoothly between the cashbox and the transporting passage, thereby ensuring the smooth transportation of paper money.

DETAILED DESCRIPTION

Hereinafter, the technical solutions in embodiments of the present invention will be described clearly and completely with reference to drawings of the embodiments of the present invention. It is apparent that the embodiments to be described are merely a portion of embodiments of the present invention, but not all of the embodiments. Based on the embodiments of the present invention, all of other embodiments made by those skilled in the art without inventive effort fall into the protection scope of the present invention.

Figure 1:
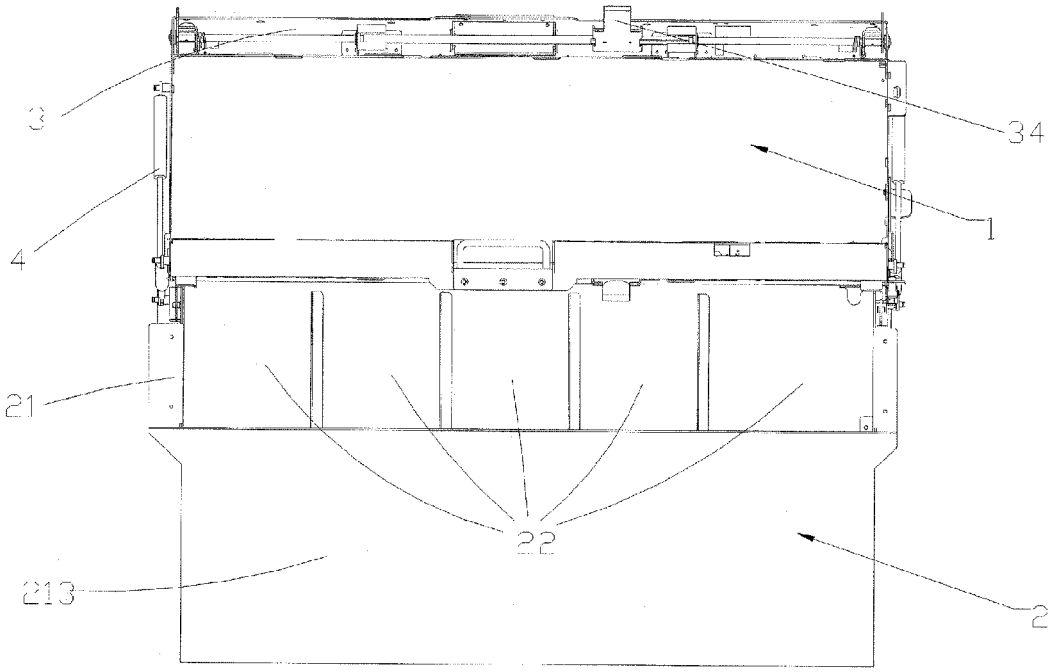
FIG. 1 is a schematic view showing the opening and closing of the paper money transporting and storing device according to the present invention.
Figure 4:
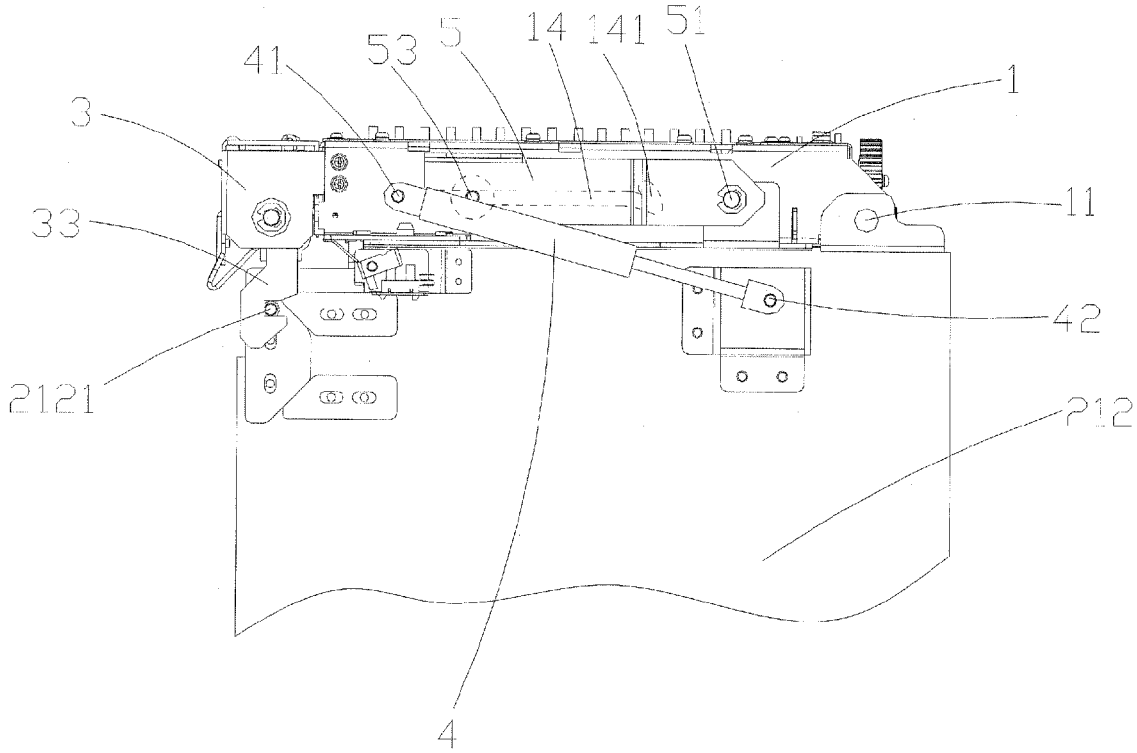
FIG. 4 is a right view of the paper money transporting and storing device showing the closed state of the passage.
Figure 5:
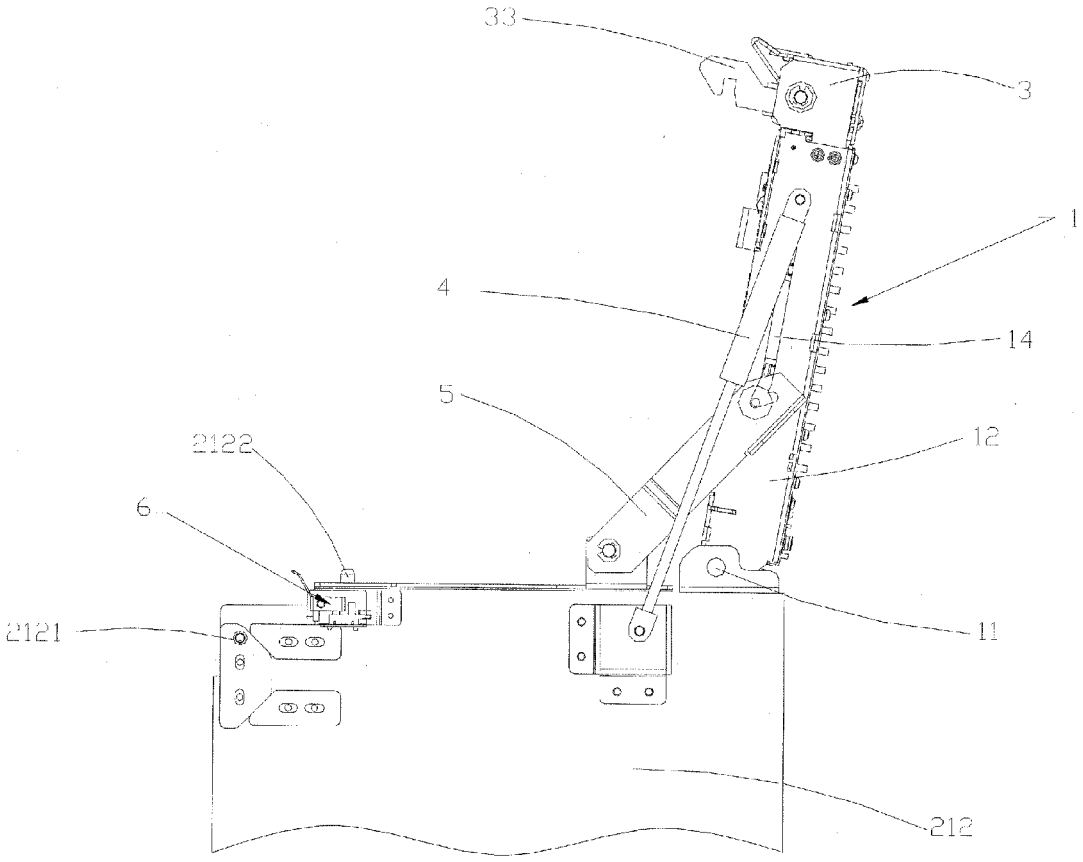
FIG. 5 is a right view of the paper money transporting and storing device showing the open state of the passage.

Referring to FIGS. 1, 4 and 5, schematic views of a paper money transporting and storing device are shown. The paper money transporting and storing device includes a paper money transporting passage 1 and a cashbox assembly 2 for storing paper money. The cashbox assembly 2 is disposed within a cashbox assembly bracket 21. The cashbox assembly bracket 21 is a box body, one surface of which may be covered by turning the paper money transporting passage 1. One end of the paper money transporting passage 1 is pivoted to a side wall 211 of the cashbox assembly bracket 21 through a pivot shaft 11. A locking mechanism 3 is provided at an end of the paper money transporting passage 1 opposite to the pivoted end. The upper portion of a side wall 213 of the cashbox assembly bracket 21 corresponding to the locking mechanism 3 is open. The open side wall 213 of the cashbox assembly bracket 21 is designed such that a cashbox 22 may be drawn out easily when replacing the cashbox 22 so as to reduce the labor intensity, which is conveniently used.

Figure 2:
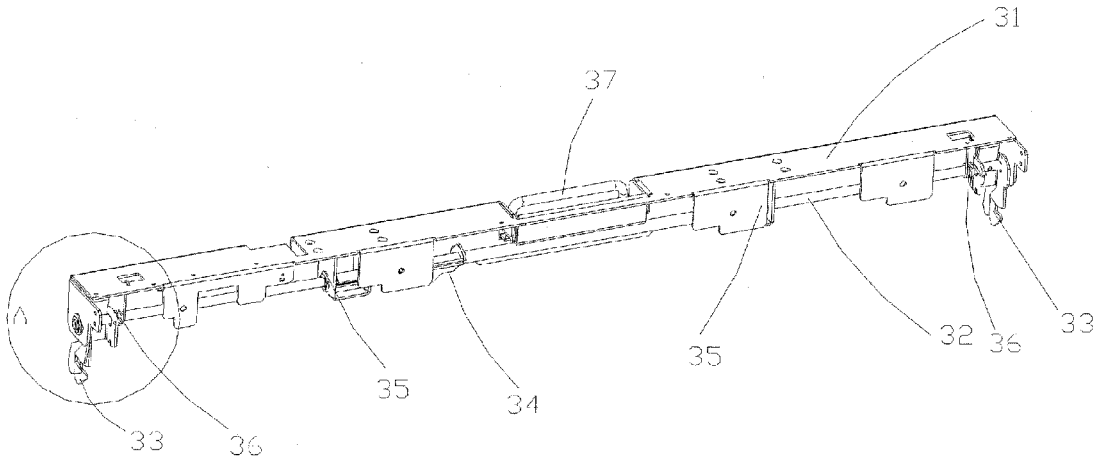
FIG. 2 is a perspective view of the locking mechanism in the paper money transporting and storing device.
Figure 3:
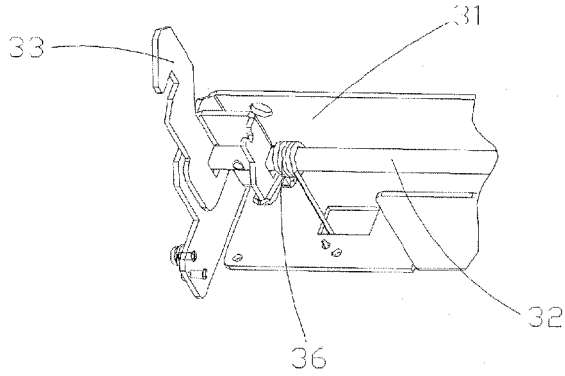
FIG. 3 is a partial enlarged view of part A in FIG. 2.

Referring to FIGS. 2 and 3, the locking mechanism 3 includes: a fixed bracket 31 which is fixed to the end of the paper money transporting passage in order to install and support components necessary for locking; a long locking member which includes a rotation shaft 32 extending across the opposite end surfaces of the fixed bracket 31 and locking hooks 33 fixed to both ends of the rotation shaft 32, wherein an openable connection is formed between the locking hooks 33 and locking pins 2121 provided on side walls 212 of the cashbox assembly bracket 21; an unlocking handle 34 which is fixed to the rotation shaft 32 in order to drive the rotation shaft 32 to freely rotate so that the locking hooks 33 are driven to be engaged with or disengaged from corresponding locking pins 2121. In the embodiment, since the locking member has a relatively long span, support members 35 are provided at appropriate positions of middle portion of the rotation shaft and properly support the rotation shaft 32 so as to allow the rotation shaft to become more stable. In order that the locking mechanism 3 may be self-locked, return torsion springs 36 for providing return force after the locking hooks 33 are disengaged from the engagement position are disposed on the rotation shaft 32 and configured to surround the rotation shaft 32. One end of each return torsion spring is fixed to the fixed bracket 31 and the other end is fixed to the locking hook 33. In addition, in order to easily turn and open the paper money transporting passage, a passage handle 37 is provided on the locking mechanism, so as to facilitate the opening and closing operation of the paper money transporting passage.

Figure 6:
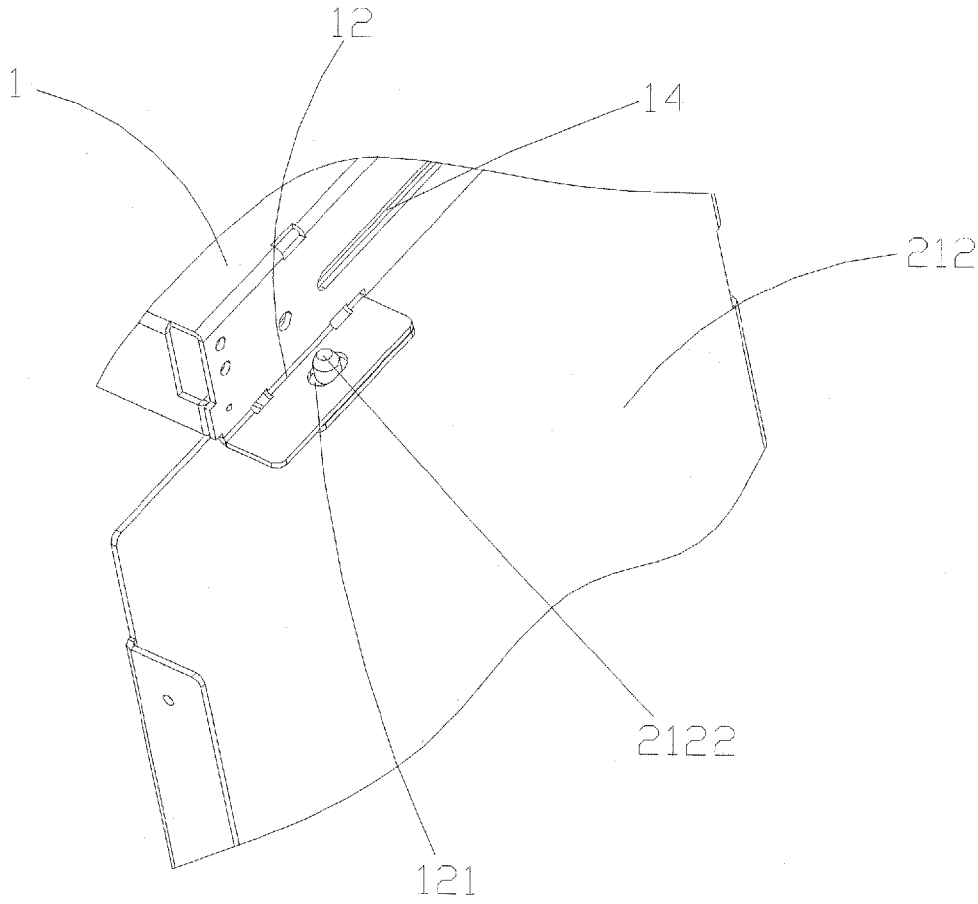
FIG. 6 is a schematic view showing the operating of the assistant positioning mechanism between the paper money transporting passage and the cashbox assembly in the present invention.

Referring to FIG. 6, a schematic view showing the operating of the assistant positioning mechanism between the paper money transporting passage and the cashbox assembly in the present invention is shown. In order to achieve a precise positioning between the paper money transporting passage 1 and the cashbox assembly 2, a positioning hole 121 is provided in the side wall 12 of the paper money transporting passage 1, and a positioning pin 2122 corresponding to the positioning hole 121 is provided on the corresponding side wall 212 of the cashbox assembly bracket 21. When the paper money transporting passage 1 is closed relative to the cashbox assembly bracket 21, the positioning pin 2122 precisely passes through the positioning hole 121, such that the paper money transporting passage 1 is closed in position relative to the cashbox assembly bracket 21. Therefore, a precise connection is achieved between the paper money transporting passage 1 and the cashbox assembly so as to ensure the smooth transportation of paper money.

Referring to FIGS. 4 and 5, since the paper money transporting passage 1 is relatively heavy, gas springs 4 for assisting to open the paper money transporting passage are provided between the paper money transporting passage 1 and the cashbox assembly bracket 21 in order to easily open the paper money transporting passage. One end 41 of each gas spring is pivoted to the side wall of the paper money transporting passage 1 and the other end 42 is pivoted to corresponding side wall 212 of the cashbox assembly bracket. When the paper money transporting passage 1 is to be opened, the unlocking handle 34 on the rotation shaft 32 of the locking mechanism 3 is drawn, and the rotation shaft 32 is rotated and then drives the locking hooks 33 to rotate, as a result, the locking hooks 33 are disengaged from the locking pins 2121. At this moment, the paper money transporting passage 1 is opened around the pivot shaft 14 under a lifting elastic force of the gas spring 4.

Figure 7:
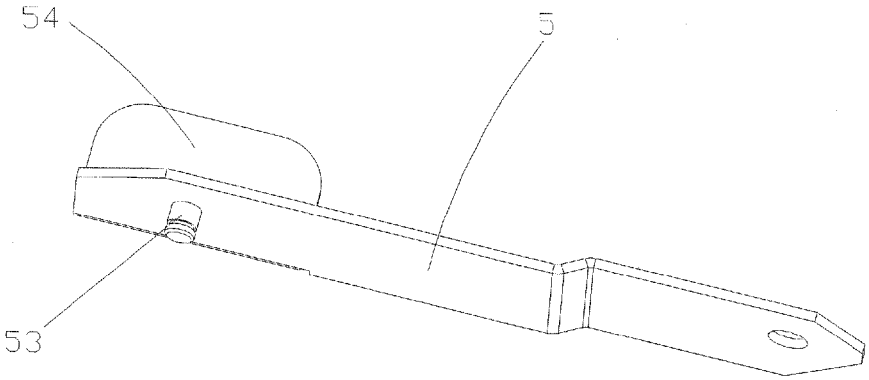
FIG. 7 is a schematic view of the rotation stop sheet assembly between the paper money transporting passage and the cashbox assembly according to the present invention.

Referring to FIGS. 4, 5 and 7, in order to limit the opening stroke of the paper money transporting passage 1, a turning stop mechanism is provided between the paper money transporting passage 1 and the cashbox assembly bracket 21. The turning stop mechanism includes a stop sheet 5. An end 51 of the stop sheet 5 is pivoted to the side wall 212 of the cashbox assembly bracket. A stop pin 53 is provided on the surface of the other end 52 of the stop sheet 5 facing the paper money transporting passage 1. A sliding groove 14 is provided on the side wall of the paper money transporting passage 1 corresponding to the stop pin 53 and is parallel to the plane of the transporting passage. An upward angled location groove 141 is formed at the end of the sliding groove 14 near the pivot shaft 11 of the transporting passage, and used to reliably stop the transporting passage 1 when the transporting passage 1 is opened in position. In addition, a releasing manipulator 54 is provided at the end of the stop sheet near the stop pin 53 to easily release the stop sheet when the paper money transporting passage 1 is to be closed.

Figure 8:
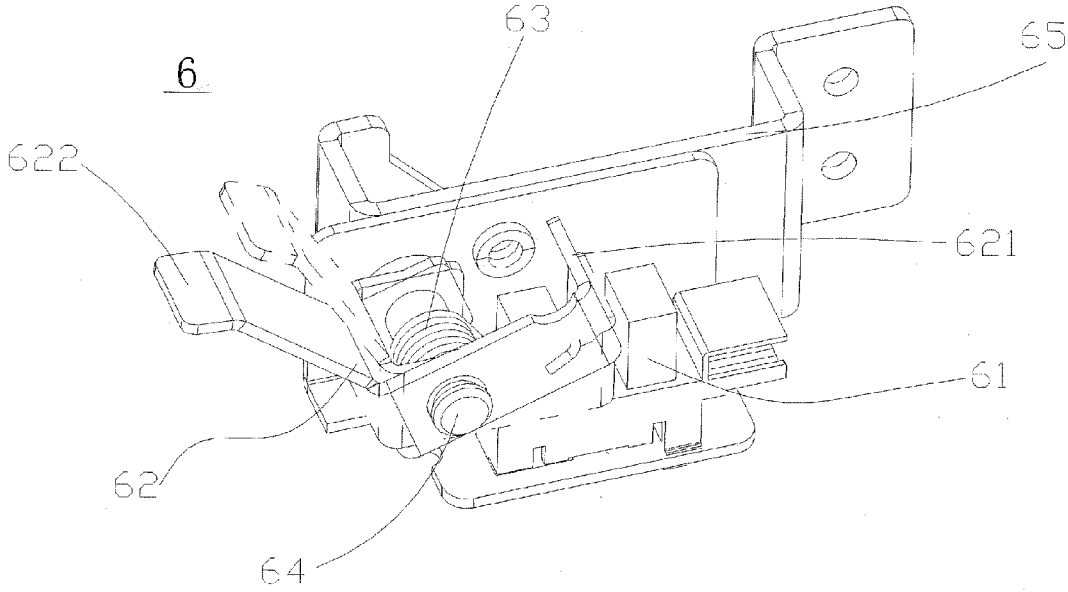
FIG. 8 is a schematic view of the detecting mechanism for detecting whether the transporting passage is closed in position relative to the cashbox assembly in the present invention.

Referring to FIGS. 4, 5 and 8, in order to detect whether the paper money transporting passage 1 is closed in position relative to the cashbox assembly, a transporting passage closed in-position detecting mechanism 6 is provided on the side wall 212 of the cashbox assembly bracket 21. The detecting mechanism 6 includes a U-shape sensor 61, a rotation member 62 and a return torsion spring 63 for automatically returning the rotation member 62. The rotation member 62 includes a check plate 621 capable of entering into the U-shape sensor 61. The rotation member 62 is pivoted to a sensor supporter 65 through a pivot shaft 64. The whole sensor is fixed to the side wall 212 of the cashbox assembly bracket by way of the supporter 65. The return torsion spring 63 is configured to surround the pivot shaft 64. One end of the return torsion spring 63 is fixed to the rotation member 62, and the other end is fixed to the sensor supporter 65. A paper money transporting passage pressing handle 622 is provided at one end of the rotation member 62 opposite to the sensor check plate 621. The pressing handle 622 and the sensor check plate 621 forms a V-shape rotation member. When the paper money transporting passage 1 is closed in position, the transporting passage presses the pressing handle 622 so as to rotate the V-shape rotation member around the pivot shaft 64, such that the sensor check plate 621 departs from the U-shape sensor 61. After the paper money transporting passage 1 is opened, the V-shape rotation member is rotated in a reverse direction by the return torsion spring 63, such that the sensor check plate 621 enters into the U-shape sensor 61. According to information whether the U-shape sensor is blocked, a control centre of the system (not shown) may determine whether the paper money transporting passage is closed in position. In the embodiment, when the U-shape sensor is blocked, it is determined that the paper money transporting passage isn't closed, and when the U-shape sensor isn't blocked, it is determined that the paper money transporting passage is closed in position.

While the preferred embodiments of the present invention have been described above, it is not intended to limit the protection scope of the present invention. Therefore, various equivalent variations made by those skilled in the art based on the contents described in the Description and illustrated in drawings of the present invention are deemed to fall into the protection scope of the present invention.

What is claimed is:

1. A paper money transporting and storing device, comprising:

a paper money transporting passage;

a cashbox assembly for storing paper money, wherein:

the cashbox assembly is disposed within a cashbox assembly bracket, the cashbox assembly bracket is a box body, one surface of which may be covered by turning the paper money transporting passage, and one end of the paper money transporting passage is pivoted to a side wall of the cashbox assembly bracket; and a locking mechanism that is provided at the other end of the paper money transporting passage opposite to the pivoted end, the locking mechanism comprising:

a fixed bracket, which is fixed to the other end of the paper money transporting passage in order to install and support components necessary for locking;

a long locking member, which comprises a rotation shaft extending across opposite end surfaces of the fixed bracket and locking hooks fixed to both ends of the rotation shaft, wherein an openable connection is formed between the locking hooks and locking pins correspondingly provided on side walls of the cashbox assembly bracket; and an unlocking handle, which is fixed to the rotation shaft in order to drive the rotation shaft to freely rotate so that the locking hooks are driven to be engaged with or disengaged from corresponding locking pins.

2. The paper money transporting and storing device according to claim 1, wherein:

return torsion spring is provided on the rotation shaft, one end of the return torsion spring is fixed to the fixed bracket, and the other end of the return torsion spring is fixed relative to the rotation shaft, so as to provide return force after the locking hooks are disengaged from an engagement position.

3. The paper money transporting and storing device according to claim 1, wherein:

a positioning assistant member having a positioning hole is provided on the side wall of the paper money transporting passage, and a positioning pin corresponding to the positioning hole is provided on corresponding side wall of the cashbox assembly bracket.

4. The paper money transporting and storing device according to claim 1, wherein:

a gas spring is provided between the paper money transporting passage and the cashbox assembly bracket, one end of the gas spring is pivoted to the side wall of the paper money transporting passage, and the other end of the gas spring is pivoted to corresponding side wall of the cashbox assembly bracket.

5. The paper money transporting and storing device according to claim 1, wherein:

a turning stop mechanism is provided between the paper money transporting passage and the cashbox assembly bracket, the turning stop mechanism comprises a stop sheet, one end of the stop sheet is pivoted to the side wall of the cashbox assembly bracket, a stop pin is provided on a surface of the other end of the stop sheet facing the paper money transporting passage, a sliding groove is provided on the side wall of the paper money transporting passage corresponding to the stop pin and is parallel to the plane of the transporting passage, and an upward angled location groove is formed at the end of the sliding groove near a pivot shaft of the transporting passage and used to reliably stop the transporting passage when the transporting passage is opened in position.

6. The paper money transporting and storing device according to claim 1, wherein a transporting passage closed in-position detecting mechanism is provided on the side wall of the cashbox assembly bracket.

7. The paper money transporting and storing device according to claim 6, wherein the detecting mechanism comprises a U-shape sensor, a rotation member and a return torsion spring for returning the rotation member, the rotation member has a check plate capable of entering into the U-shape sensor.

8. The paper money transporting and storing device according to claim 7, wherein the rotation member is pivoted to the side wall of the cashbox assembly bracket through a second pivot shaft, the return torsion spring is surroundingly connected to the second pivot shaft, one end of the return torsion spring is fixed to the rotation member, the other end of the return torsion spring is fixed to the second pivot shaft or a fixing mechanism of the second pivot shaft.

9. The paper money transporting and storing device according to claim 7, wherein a paper money transporting passage pressing handle is provided at one end of the rotation member opposite to the sensor check plate, and wherein the pressing handle and the sensor check plate form a V-shape rotation member, when the paper money transporting passage is closed in position, the transporting passage presses the pressing handle so as to rotate the V-shape rotation member around the pivot shaft, such that the sensor check plate departs from the U-shape sensor; and after the paper money transporting passage is opened, the V-shape rotation member is rotated in a reverse direction by the return torsion spring, such that the sensor check plate enters into the U-shape sensor.

10. The paper money transporting and storing device according to claim 1, wherein the cashbox assembly bracket is configured to be open at an upper portion of the side wall thereof corresponding to the locking mechanism.

* * * * *